US011674405B2

(12) United States Patent
Johnson et al.

(10) Patent No.: US 11,674,405 B2
(45) Date of Patent: Jun. 13, 2023

(54) ABRADABLE INSERT WITH LATTICE STRUCTURE

(71) Applicant: General Electric Company, Schenectady, NY (US)

(72) Inventors: Steven Douglas Johnson, Milford, OH (US); Neelesh Nandkumar Sarawate, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/461,142

(22) Filed: Aug. 30, 2021

(65) Prior Publication Data

US 2023/0060175 A1 Mar. 2, 2023

(51) Int. Cl.
*F01D 11/12* (2006.01)

(52) U.S. Cl.
CPC ..... *F01D 11/125* (2013.01); *F05D 2220/32* (2013.01); *F05D 2230/31* (2013.01); *F05D 2240/55* (2013.01)

(58) Field of Classification Search
CPC ..... F01D 11/125; F05D 2220/32; F05D 2230/31; F05D 2240/55
See application file for complete search history.

(56) References Cited

U.S. PATENT DOCUMENTS 3,423,070 A 1/1969 Corrigan
3,603,599 A 9/1971 Laird
3,728,039 A 4/1973 Plemmons et al.
4,101,242 A 7/1978 Coplin et al.
4,139,376 A * 2/1979 Erickson ..... C22C 47/06 277/411
4,273,824 A * 6/1981 McComas ..... C23C 4/02 427/328
4,534,698 A 8/1985 Tomich
4,639,388 A 1/1987 Ainsworth et al.
4,832,999 A 5/1989 Sweet
4,867,639 A 9/1989 Strangman
5,080,557 A 1/1992 Berger
5,127,794 A 7/1992 Burge et al.
5,160,248 A * 11/1992 Clarke ..... F01D 21/045 428/117

(Continued)

FOREIGN PATENT DOCUMENTS

CN 103128972 A 6/2013
DE 10347335 A1 5/2005

(Continued)

OTHER PUBLICATIONS

"Hastelloy X alloy Principal Features".*

*Primary Examiner* — Igor Kershteyn
*Assistant Examiner* — Theodore C Ribadeneyra
(74) *Attorney, Agent, or Firm* — Dority & Manning, P.A.

(57) ABSTRACT

An abradable insert for a gas turbine engine, the abradable insert including: a base layer; a lattice layer connected to the base layer, wherein the lattice layer comprises a series of walls that define a plurality of cells; and a sheet layer connected to the lattice layer on an opposite side on the lattice layer from the base layer, wherein the sheet layer is curved and includes a direction of concavity that points away from the base layer, wherein the lattice layer and the sheet layer are integrally formed together and are a monolithic piece of material.

18 Claims, 5 Drawing Sheets

(56) References Cited

U.S. PATENT DOCUMENTS

| | | | | |
|---|---|---|---|---|
| 5,174,714 | A | 12/1992 | Plemmons et al. | |
| 5,195,868 | A | 3/1993 | Plemmons et al. | |
| 5,277,959 | A | 1/1994 | Kourtides et al. | |
| 5,562,408 | A | 10/1996 | Proctor et al. | |
| 5,704,759 | A | 1/1998 | Draskovich et al. | |
| 6,123,170 | A | 9/2000 | Porte et al. | |
| 6,251,494 | B1 | 6/2001 | Schreiber | |
| 6,575,699 | B1 | 6/2003 | Jones | |
| 6,739,593 | B2 | 5/2004 | Fried | |
| 7,147,429 | B2 | 12/2006 | Czachor et al. | |
| 7,390,161 | B2 * | 6/2008 | Xie | D04C 1/02 415/174.4 |
| 7,402,022 | B2 * | 7/2008 | Harper | F01D 21/045 415/214.1 |
| 7,604,095 | B2 | 10/2009 | Mitchell | |
| 7,766,609 | B1 | 8/2010 | Liang | |
| 9,169,045 | B2 | 10/2015 | Clark | |
| 9,822,659 | B2 | 11/2017 | Arikawa et al. | |
| 10,718,352 | B2 * | 7/2020 | Alban | F01D 11/127 |
| 2002/0036115 | A1 | 3/2002 | Wilson | |
| 2003/0156940 | A1 | 8/2003 | Czachor et al. | |
| 2004/0047726 | A1 | 3/2004 | Morrison | |
| 2004/0163888 | A1 | 8/2004 | Johnson | |
| 2007/0122269 | A1 | 5/2007 | Meier et al. | |
| 2008/0258404 | A1 | 10/2008 | Pillhoefer | |
| 2008/0260522 | A1 | 10/2008 | Alvanos | |
| 2009/0277153 | A1 | 11/2009 | Harper et al. | |
| 2011/0206502 | A1 | 8/2011 | Rulli et al. | |
| 2013/0129494 | A1 * | 5/2013 | Duchaine | B23P 15/00 415/213.1 |
| 2013/0139386 | A1 | 6/2013 | Lacy et al. | |
| 2016/0076402 | A1 * | 3/2016 | Benson | F01D 25/28 415/196 |
| 2016/0215646 | A1 * | 7/2016 | Gonyou | F01D 11/025 |
| 2016/0237836 | A1 * | 8/2016 | Harris | F01D 25/24 |
| 2017/0096902 | A1 * | 4/2017 | Novovic | F01D 25/005 |
| 2017/0307137 | A1 * | 10/2017 | Tyan | E04C 2/36 |
| 2018/0031000 | A1 * | 2/2018 | Alban | F01D 11/127 |
| 2018/0050392 | A1 * | 2/2018 | Mason-Flucke | F01D 5/147 |
| 2018/0050422 | A1 * | 2/2018 | Fong | F04D 29/162 |
| 2018/0057060 | A1 * | 3/2018 | Tyan | B32B 27/34 |
| 2018/0058530 | A1 * | 3/2018 | Tyan | B32B 25/10 |
| 2018/0355744 | A1 * | 12/2018 | Jakimov | F01D 11/122 |
| 2018/0355745 | A1 * | 12/2018 | Mathew | F01D 11/127 |
| 2019/0178387 | A1 * | 6/2019 | Nayak | F01D 11/02 |
| 2019/0270504 | A1 * | 9/2019 | Cedar | B64C 1/066 |
| 2019/0301370 | A1 * | 10/2019 | Joshi | E04B 1/74 |
| 2020/0263558 | A1 | 8/2020 | Anand et al. | |

FOREIGN PATENT DOCUMENTS

| | | | |
|---|---|---|---|
| DE | 102005041830 | A1 | 3/2007 |
| DE | 102010062087 | A1 | 5/2012 |
| EP | 1336739 | A2 | 8/2003 |
| EP | 2009141 | A2 | 12/2008 |
| EP | 2196632 | A2 | 6/2010 |
| FR | 3060608 | A1 | 6/2018 |
| GB | 2426287 | A | 11/2006 |
| JP | S5425989 | A | 2/1979 |
| JP | S54144486 | A | 11/1979 |
| JP | 2000257402 | A | 9/2000 |
| JP | 2001123803 | A | 5/2001 |
| JP | 2001234707 | A | 8/2001 |
| JP | 2002004806 | A | 1/2002 |
| JP | 2005201275 | A | 7/2005 |
| JP | 2007516111 | A | 6/2007 |
| JP | 2012512745 | A | 6/2012 |
| JP | 2012519803 | A | 8/2012 |

* cited by examiner

ABRADABLE INSERT WITH LATTICE STRUCTURE

FIELD

The present disclosure relates to a gas turbine engine. In particular, the present disclosure relates to an abradable insert for use in a gas turbine engine.

BACKGROUND

A gas turbine engine generally includes a turbomachine and a rotor assembly. Gas turbine engines, such as turbofan engines, may be used for aircraft propulsion. In the case of a turbofan engine, the rotor assembly may be configured as a fan assembly.

In gas turbine engines, abradable materials may be provided to enhance a sealing interface between a stationary component and a rotating component. Existing processes to construct abradables include brazing layers together to form the abradable material. Such processes require a minimum wall thickness of the material as well as the addition of brazing joints, which can add significant thickness to the layers of material. The inventors of the present disclosure have found that such aspects of existing abradable materials can cause undesirable wear on a rotary seal component as well as create large amounts of thermal energy due to the large thicknesses of the abradable materials and braze joints. Accordingly, the inventors of the present disclosure have found that improvements to these abradable materials would be beneficial.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
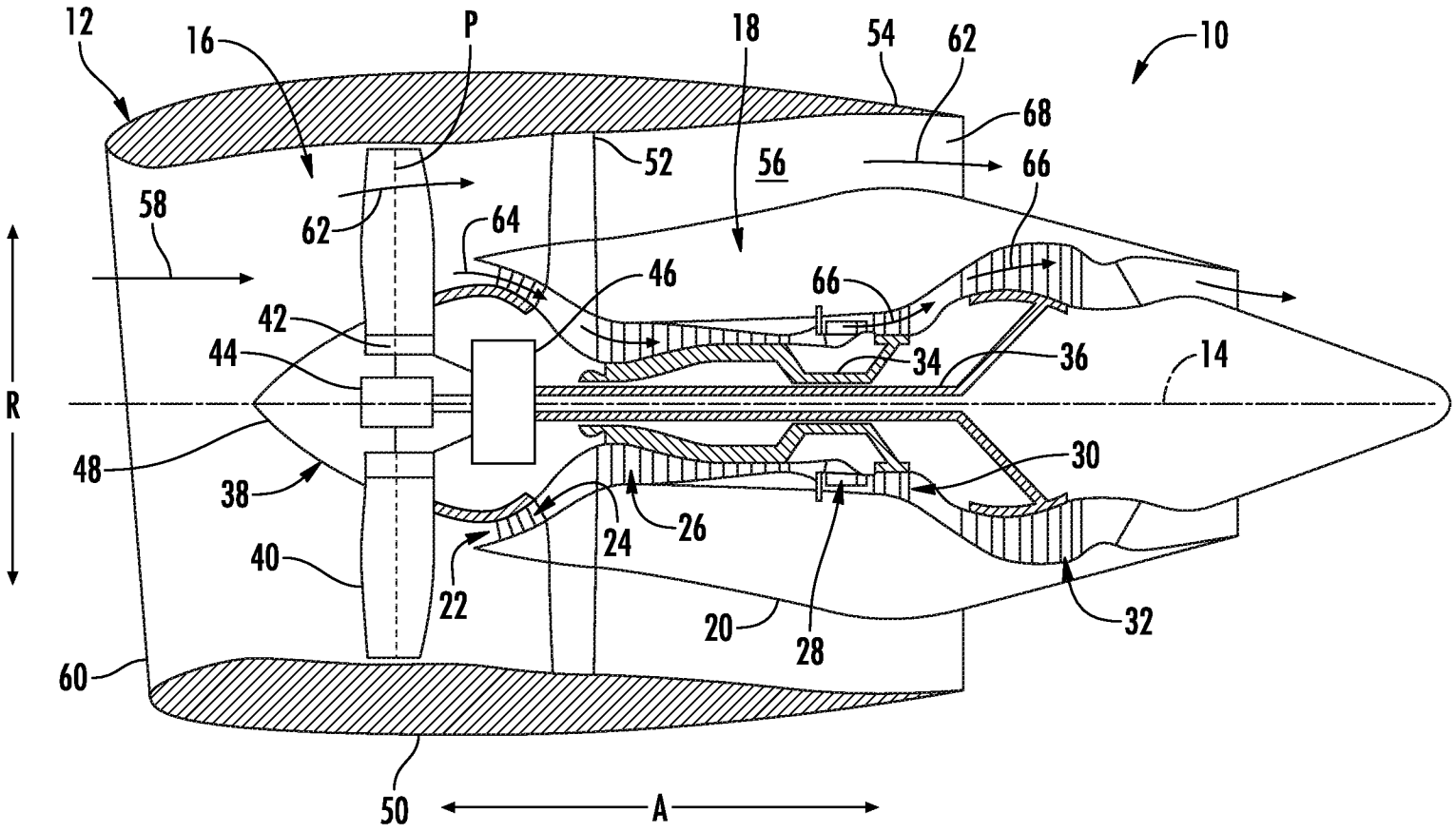
FIG. 1 is a cross-section view of a gas turbine engine in accordance with an exemplary aspect of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 10, 15, or 20 percent margin. These approximating margins may apply to a single value, either or both endpoints defining numerical ranges, and/or the margin for ranges between endpoints.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

The terms "low" and "high", or their respective comparative degrees (e.g., -er, where applicable), when used with a compressor, a turbine, a shaft, or spool components, etc. each refer to relative speeds within an engine unless otherwise specified. For example, a "low turbine" or "low speed turbine" defines a component configured to operate at a rotational speed, such as a maximum allowable rotational speed, lower than a "high turbine" or "high speed turbine" at the engine.

The term "turbomachine" or "turbomachinery" refers to a machine including one or more compressors, a heat generating section (e.g., a combustion section), and one or more turbines that together generate a torque output.

The term "gas turbine engine" refers to an engine having a turbomachine as all or a portion of its power source. Example gas turbine engines include turbofan engines, turboprop engines, turbojet engines, turboshaft engines, etc.

The term "combustion section" refers to any heat addition system for a turbomachine. For example, the term combustion section may refer to a section including one or more of a deflagrative combustion assembly, a rotating detonation combustion assembly, a pulse detonation combustion assembly, or other appropriate heat addition assembly. In certain example embodiments, the combustion section may include an annular combustor, a can combustor, a cannular combustor, a trapped vortex combustor (TVC), or other appropriate combustion system, or combinations thereof.

The term "layer-by-layer additive manufacturing" refers generally to manufacturing processes wherein successive layers of material(s) are provided on each other to "build-up," layer-by-layer, a three-dimensional component. The successive layers generally fuse together to form a monolithic component which may have a variety of integral sub-components. Although additive manufacturing technology is described herein as enabling fabrication of complex objects by building objects point-by-point, layer-by-layer, typically in a vertical direction, other methods of fabrication are possible and within the scope of the present subject matter. For example, although the discussion herein refers to the addition of material to form successive layers, one skilled in the art will appreciate that the methods and structures disclosed herein may be practiced with any additive manufacturing technique or manufacturing technology. For example, embodiments of the present disclosure may use layer-additive processes, layer-subtractive processes, or hybrid processes.

Suitable additive manufacturing techniques in accordance with the present disclosure include, for example, Fused Deposition Modeling (FDM), Selective Laser Sintering (SLS), 3D printing such as by inkjets, laser jets, and binder jets, Sterolithography (SLA), Direct Selective Laser Sintering (DSLS), Electron Beam Sintering (EBS), Electron Beam Melting (EBM), Laser Engineered Net Shaping (LENS), Laser Net Shape Manufacturing (LNSM), Direct Metal Deposition (DMD), Digital Light Processing (DLP), Direct Selective Laser Melting (DSLM), Selective Laser Melting (SLM), Direct Metal Laser Melting (DMLM), and other known processes.

The additive manufacturing processes described herein may be used for forming components using any suitable material. In addition, it will be appreciated that a variety of materials and methods for bonding those materials may be used and are contemplated as within the scope of the present disclosure. In addition, the additive manufacturing process disclosed herein may allow a single component to be formed from multiple materials. Thus, the components described herein may be formed from any suitable mixtures of materials.

The additive manufacturing methods described above enable much more complex and intricate shapes and contours of the components described herein. For example, such components may include thin additively manufactured layers and unique fluid passageways and manifolds with integral mounting features. In addition, the additive manufacturing process enables the manufacture of a single component having different materials such that different portions of the component may exhibit different performance characteristics. The successive, additive nature of the manufacturing process enables the construction of these novel features. As a result, the components described herein may exhibit improved functionality and reliability.

The present disclosure is related to abradable inserts for rotary seal assemblies (e.g., labyrinth seals) used in gas turbine engines. In certain designs, abradable materials with exposed honeycomb cells may be incorporated into the inserts to provide a rough surface due to the exposed honeycomb cells. With honeycomb cells that are totally exposed to surrounding air, a lot of stator-drag and windage (e.g., windage within a rotor cavity) may be produced during operation of the engine.

Aspects of the present disclosure present an abradable insert with a thin cylindrical foil at an inner diameter surface of the honeycomb cells. Additional cylindrical foils could be integrated at various intervals along the honeycomb height for structural reinforcement to enable larger size of the honeycomb cells size, which may enable a reduction in air flow across the insert where a rub groove forms. The thin cylindrical foils provide a smooth airflow surface that may enable reduced windage and leakage improvement. Additionally, or alternatively, dimples may be utilized in the cylindrical foils at each honeycomb cell to provide thermal strain relief for the cylindrical foils, aerodynamic benefits, etc. Additionally, or alternatively, gaps may be formed in the cylindrical foils for further strain relief.

Referring now to the drawings, wherein identical numerals indicate the same elements throughout the figures, FIG. 1 is a schematic, cross-sectional view of a propulsion system 10 in accordance with an exemplary embodiment of the present disclosure. More particularly, for the embodiment of FIG. 1, propulsion system 10 includes a gas turbine engine, referred to herein as "turbofan engine 12." In one example, turbofan engine 12 can be a high-bypass turbofan jet engine. As shown in FIG. 1, turbofan engine 12 defines an axial direction A (extending parallel to longitudinal centerline 14 provided for reference) and a radial direction R. In general, turbofan engine 12 includes a fan section 16 and a turbomachine 18 disposed downstream from fan section 16.

The exemplary turbomachine 18 depicted generally includes a substantially tubular outer casing 20 that defines an annular inlet 22. Outer casing 20 encases, in serial flow order/relationship, a compressor section including a booster or low pressure compressor 24 ("LP compressor 24") and a high pressure compressor 26 ("HP compressor 26"); a combustion section 28; a turbine section including a high pressure turbine 30 (HP turbine 30") and a low pressure turbine 32 ("LP turbine 32"); and a combustion section 28. A high pressure shaft or spool 34 ("HP spool 34") drivingly connects HP turbine 30 to HP compressor 26. A low pressure shaft or spool 36 ("LP spool 36") drivingly connects LP turbine 32 to LP compressor 24.

For the embodiment depicted, fan section 16 includes a variable pitch fan 38 having a plurality of fan blades 40 coupled to a disk 42 in a spaced apart manner. As depicted, fan blades 40 extend outwardly from disk 42 generally along radial direction R. Each fan blade 40 is rotatable relative to disk 42 about a pitch axis P by virtue of fan blades 40 being operatively coupled to a suitable actuation member 44 configured to collectively vary the pitch of fan blades 40, e.g., in unison. Fan blades 40, disk 42, and actuation member 44 are together rotatable about longitudinal centerline 14 by LP spool 36 across a power gear box 46. Power gear box 46 includes a plurality of gears for stepping down the rotational speed of LP spool 36 to a more efficient rotational fan speed.

Referring still to the exemplary embodiment of FIG. 1, disk 42 is covered by a rotatable front hub 48 aerodynamically contoured to promote an airflow through the plurality of fan blades 40. Additionally, fan section 16 includes an annular fan casing or outer nacelle 50 that circumferentially surrounds variable pitch fan 38 and/or at least a portion of turbomachine 18. It should be appreciated that in some embodiments, nacelle 50 is configured to be supported relative to turbomachine 18 by a plurality of circumferentially spaced outlet guide vanes 52. Moreover, a downstream section 54 of nacelle 50 extends over an outer portion of turbomachine 18 so as to define a bypass airflow passage 56 therebetween.

During operation of turbofan engine 12, a volume of air 58 enters turbofan engine 12 through an associated inlet 60 of nacelle 50 and/or fan section 16. As the volume of air 58 passes across fan blades 40, a first portion of air 58 as indicated by arrows 62 is directed or routed into bypass airflow passage 56 and a second portion of air 58 as indicated by arrow 64 is directed or routed into LP compressor 24. The ratio between first portion of air 62 and second portion of air 64 is commonly known as a bypass ratio. The pressure of second portion of air 64 is then increased as it is routed through high pressure (HP) compressor 26 and into combustion section 28, where it is mixed with fuel and burned to provide combustion gases 66. Subsequently, combustion gases 66 are routed through HP turbine 30 and LP turbine 32, where a portion of thermal and/or kinetic energy from combustion gases 66 is extracted.

Combustion gases 66 are then routed through combustion section 28 of turbomachine 18 to provide propulsive thrust. Simultaneously, the pressure of first portion of air 62 is substantially increased as first portion of air 62 is routed through bypass airflow passage 56 before it is exhausted from fan nozzle exhaust section 68 of turbofan engine 12, also providing propulsive thrust.

It should be appreciated, however, that turbofan engine 12 depicted in FIG. 1 is by way of example only, and that in other exemplary embodiments, aspects of the present disclosure may additionally, or alternatively, be applied to any other suitable gas turbine engine. For example, in other exemplary embodiments, turbofan engine 12 may instead be any other suitable aeronautical gas turbine engine, such as a turbojet engine, turboshaft engine, turboprop engine, etc. Additionally, in still other exemplary embodiments, turbofan engine 12 may include any other suitable number and/or configuration of shafts, spools, compressors, turbines, etc.; may be configured as a direct drive engine (e.g., excluding power gear box 46); may be a fixed-pitch fan; etc.

Figure 2:
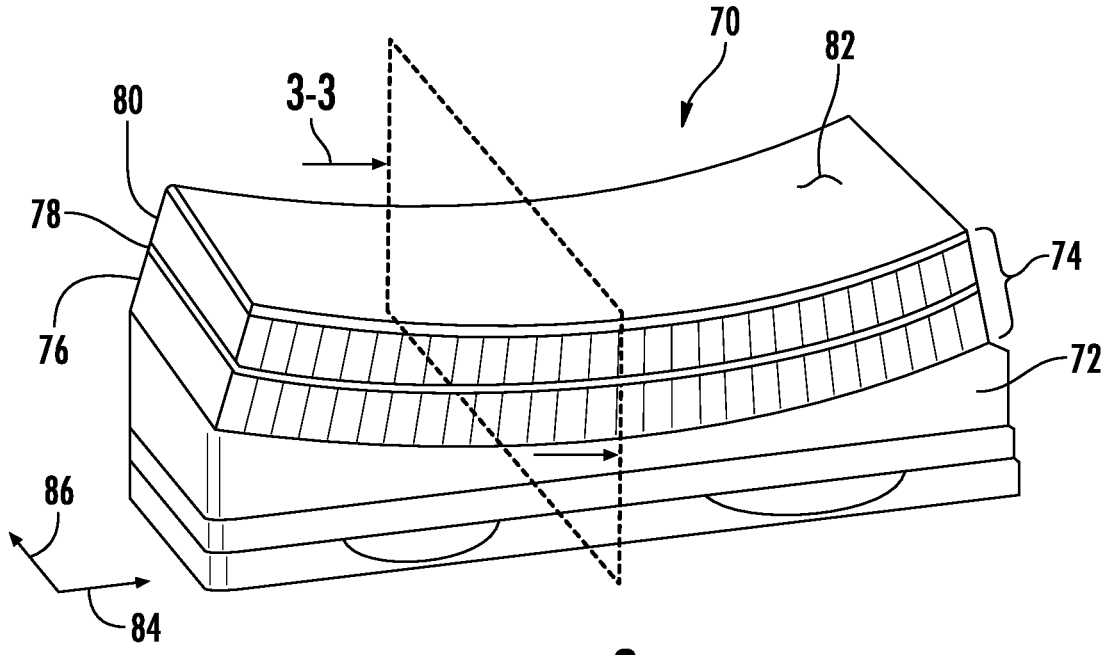
FIG. 2 is a perspective view of an abradable insert in accordance with an exemplary aspect of the present disclosure.

Referring now to FIG. 2, FIG. 2 is a perspective view of an insert 70 in accordance with an exemplary embodiment of the present disclosure.

Insert 70 is an abradable insert for use in propulsion system 10 (see, e.g., FIG. 1). Put another way, insert 70 is operable with a component of propulsion system 10. In certain exemplary embodiments, insert 70 can form a portion of an abradable seal configured to engage with a labyrinth seal or a tip shroud seal for LP turbine 32 of turbofan engine 12 (see e.g., FIG. 1). In another exemplary embodiment, insert 70 can be configured to form sealing interface with a labyrinth seal or a tip shroud seal for LP turbine 32 of turbofan engine 12 (see e.g., FIG. 1). In yet another exemplary embodiment, insert 70 can be configured to abradably engage with a labyrinth seal or a tip shroud seal for LP turbine 32 of turbofan engine 12 (see e.g., FIG. 1).

Insert 70 includes a base layer 72, a lattice layer 74 (with a first layer 76, an intermediate sheet layer 78, and a second layer 80), and a sheet layer 82. Insert 70 is used in propulsion system 10 by installing or situating a plurality of inserts 70 around a circumference of a rotating element of propulsion system 10 (e.g., any of rotor blades/fan blades 40 of the LP compressor 24, HP compressor 26, HP turbine 30, LP turbine 32, or fan 38). In this way, the plurality of inserts 70 form a ring shaped abradable seal.

In this example, base layer 72 is a block of solid material such as metal. Base layer 72 is connected to lattice layer 74. In certain exemplary embodiments, lattice layer 74 can be attached or mounted to base layer via mechanical or chemical attachment means. In other exemplary embodiments, base layer 72 and lattice layer 74 can be integrally formed together as a single monolithic piece of material with layer-by-layer additive manufacturing.

In this example, lattice layer 74 includes first layer 76, intermediate sheet layer 78, and second layer 80. As will be explained in more detail below, first layer 76 and second layer 80 are layers of cellular material and include a series of walls that define a plurality of cells. In certain exemplary embodiments, first layer 76 and second layer 80 can include a three-dimensional lattice configuration or a honeycomb cell structure.

Intermediate sheet layer 78 is a thin layer of solid material that is disposed between base layer 72 and sheet layer 82. In this example, intermediate sheet layer 78 divides a plurality of cells of lattice layer 74 into first layer 76 and second layer 80.

Intermediate sheet layer 78 is curved along a first direction 84 and is flat along a second direction 86, with second direction 86 being perpendicular to first direction 84. In certain exemplary embodiments, intermediate sheet layer 78 can be integrally formed together with first layer 76 and second layer 80 with layer-by-layer additive manufacturing.

Sheet layer 82 is another thin piece of solid material or foil that is connected to lattice layer 74 along second layer 80. In this example, sheet layer 82 is curved along the first direction 84 and is flat along the second direction 86. Sheet layer 82 include a direction of concavity that points away from base layer 72. Additionally, for the embodiment shown, the exposed surfaces of sheet layer 82 are smooth (e.g., even and non-porous). When a plurality of inserts 70 are put together to form a ring of inserts 70 with first direction 84 being a circumferential direction, a plurality of sheet layers 82 of the plurality of inserts 70 form a thin cylindrical foil along an inner diameter of the ring of inserts 70. Sheet layer 82 is connected to lattice layer 74 on an opposite side on lattice layer 74 from base layer 72. In certain exemplary embodiments, the exposed surface of sheet layer 82 defines a flowpath surface wall of propulsion system 10.

In certain exemplary embodiments, two or more of base layer 72, first layer 76, intermediate sheet layer 78, second layer 80, and sheet layer 82 can be integrally formed together as a single monolithic piece of material with layer-by-layer additive manufacturing.

In other exemplary embodiments, a material of insert 70 can include a nickel alloy with a temperature threshold of greater than 700° Fahrenheit (e.g., up to a melting point of 2,500° F.). For example, as used herein, the term "temperature threshold" can indicate a temperature limit above which the material of insert 70 will not be durable for a desired engine life. Failure to meet a desired durability could be due to several reasons such as oxidation or erosion of the material that degrades at higher temperature. In at least certain exemplary aspects, a material of insert 70 (and/or one or more of base layer 72, first layer 76, intermediate sheet layer 78, second layer 80, and sheet layer 82) can include a nickel-chromium-aluminum-iron alloy or a nickel-molybdenum alloy.

During operation, in the instance of a rub event (e.g., when a rotary seal component of propulsion system 10 comes into contact with and abrades a portion of insert 70), a portion of sheet layer 82 is abraded away from insert 70. In such an instance, the remaining portions of insert 70 that did not take a rub, remain intact with a smooth sheet layer 82 remaining on the portion of insert 70 that did not take a rub.

With smooth sheet layer 82 remaining mostly intact, a drag force against air flowing across insert 70 is lower which allows the air to spin faster. With the air spinning faster, the corresponding rotating element (e.g., a rotor of LP compressor 24, HP compressor 26, HP turbine 30, or LP turbine 32) is producing less heat and less windage leading to less parasitic loss on the rotor and onto the air. Put another way, the unrubbed smooth surface of sheet layer 82 reduces windage in the area surrounding insert 70. For example, a reduction in windage in the area surrounding insert 70 can improve cavity temperatures and help to reduce parasitic pressure and temperature losses of propulsion system 10.

Figure 3:
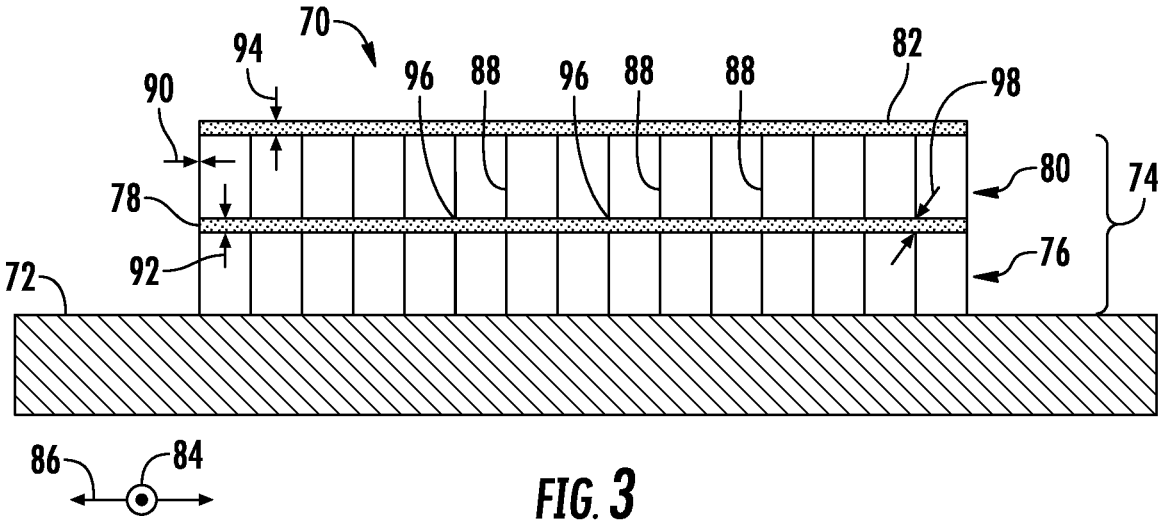
FIG. 3 is a cross-section view of the abradable insert taken along 3-3 in FIG. 2 and shows a base layer, lattice layers, and intermediate sheet layer, and a sheet layer in accordance with another exemplary aspect of the present disclosure.

Referring now to FIG. 3, FIG. 3 is a cross-section view of insert 70 taken along 3-3 in FIG. 2 and in accordance with an exemplary embodiment of the present disclosure.

Here, first layer 76 and second layer 80 are shown to include walls 88 and joints 96. Walls 88 are shown as vertical line segments in FIG. 3 and are thin planar pieces of solid material such as metal. Each wall 88 of walls 88 includes a thickness 90. Thickness 90 may refer to a maximum thickness of the respective wall 88.

In certain exemplary embodiments, thickness 90 of each wall 88 of the series of walls 88 is less than or equal to 10.0 thousandths of an inch; such as less than or equal to 5.0 thousandths of an inch (0.127 millimeters); such as less than or equal to 3.0 thousandths of an inch (0.076 millimeters); such as at least about 0.2 thousandths of an inch.

In certain exemplary embodiments, a thickness 92 of intermediate sheet layer 78 and a thickness 94 of sheet layer 82 are less than or equal to 10.0 thousandths of an inch; such as less than or equal to 5.0 thousandths of an inch (0.127 millimeters; such as less than or equal to 3.0 thousandths of an inch (0.076 millimeters); such as at least about 0.2 thousandths of an inch. Thicknesses 92, 94 may each refer to a maximum thickness of the respective sheet layer 78, 82.

As shown in FIG. 3, joints 96 are formed at points of intersection between intermediate sheet layer 78 and walls 88. In this example, intermediate sheet layer 78 and walls 88 are integrally formed via layer-by-layer additive manufacturing. Joints 96 each define a thickness 98. Thickness 98 of the joints 96 may refer to a maximum thickness in a cross-wise direction relative to an extension between the sheet layer 78, 82 and wall 88 being joined. In certain exemplary embodiments, thicknesses 98 of joints 96 are less than or equal to 10.0 thousandths of an inch (0.254 millimeters; such as less than or equal to 7.0 thousandths of an inch (0.178 millimeters); such as less than or equal to 5.0 thousandths of an inch (0.127 millimeters); such as less than or equal to 3.0 thousandths of an inch (0.076 millimeters); such as at least about 0.2 thousandths of an inch (0.051 millimeters)). Put another way, a maximum thickness of one of joints 96 is less than or equal to 10.0 thousandths of an inch (0.254 millimeters; such as less than or equal to 7.0 thousandths of an inch (0.178 millimeters); such as less than or equal to 5.0 thousandths of an inch (0.127 millimeters); such as less than or equal to 3.0 thousandths of an inch (0.076 millimeters); such as at least about 0.2 thousandths of an inch (0.051 millimeters)).

In gas turbine engines, certain processes to construct cellular abradables include brazing the layers and cells together to form the abradable. Such a process requires a minimum wall thickness of the cell walls as well as the addition of brazing joints, which can add, e.g., 20 millimeters of material to the cell walls. These aspects of abradables can cause undesirable wear on the seal teeth as well as create large amounts of thermal energy due to the large thicknesses of the abradable walls and braze joints. Moreover, the extra brazing material adds undesirable size and mass to the abradable material.

Here, with lattice layer 74 and sheet layer 82 being integrally formed via layer-by-layer additive manufacturing, the need for thick brazing joints is eliminated and thicknesses 90, 92, 94, and 98 can be reduced down to, e.g., 3.0 thousandths of an inch or less. In this way, the weight of insert 70 may be reduced and the need for additional brazing processing is eliminated as compared to the above-described construction methods.

Additionally, the addition of intermediate sheet layer 78 provides structural reinforcement for lattice layer 74 thereby enabling a larger cell size of the honeycomb configuration of lattice layer 74 and a potential reduction in air flow when a rub groove forms as a result of a rub event.

Figure 4:
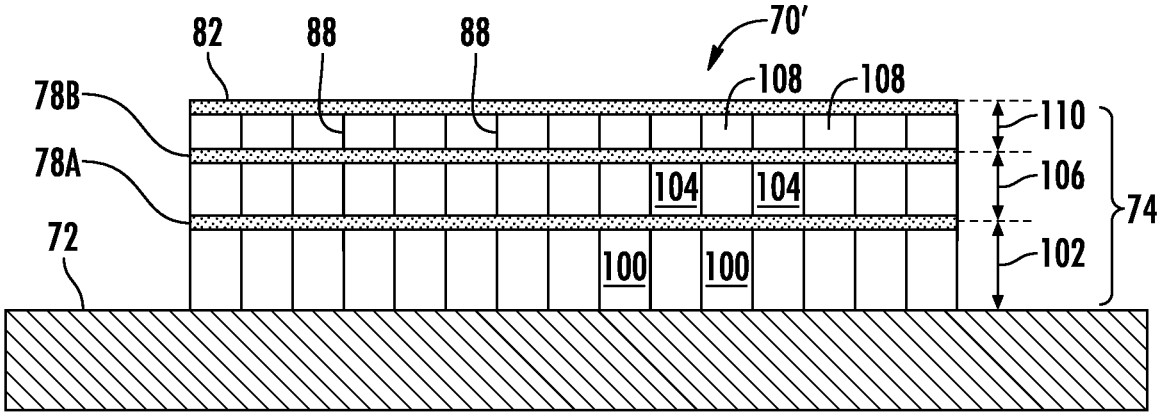
FIG. 4 is a cross-section view of an abradable insert and shows a base layer, multiple lattice layers, multiple intermediate sheet layers, and a sheet layer in accordance with yet another exemplary aspect of the present disclosure.

Referring now to FIG. 4, FIG. 4 is a cross-section view of an insert 70' and in accordance with an exemplary embodiment of the present disclosure. The insert 70' may be configured in a similar manner as the exemplary insert 70 of FIG. 3. However, as shown in FIG. 4, insert 70' includes a first intermediate sheet layer 78A and a second intermediate sheet layer 78B.

In this example, lattice layer 74 includes first cells 100. First cells 100 are enclosed portions of lattice layer 74. First cells 100 are defined on the bottom by base layer 72, on the sides by walls 88, and on the top by first intermediate sheet layer 78A (e.g., with bottom, sides, and top directions as depicted as downward, side-to-side, and upward as shown in FIG. 4). First cells 100 define a first depth 102 that extends from base layer 72 to first intermediate sheet layer 78A.

In this example, lattice layer 74 also includes second cells 104. Second cells 104 are enclosed portions of lattice layer 74. Second cells 104 are defined on the bottom by first intermediate sheet layer 78A, on the sides by walls 88, and on the top by second intermediate sheet layer 78B (e.g., with bottom, sides, and top directions as depicted as downward, side-to-side, and upward as shown in FIG. 4). Second cells 104 define a second depth 106 that extends from first intermediate sheet layer 78A to second intermediate sheet layer 78B. In certain exemplary embodiments, second depth 106 can be less than or equal to first depth 102.

In this example, lattice layer 74 also includes third cells 108. Third cells 108 are enclosed portions of lattice layer 74. Third cells 108 are defined on the bottom by second intermediate sheet layer 78B, on the sides by walls 88, and on the top by sheet layer 82 (e.g., with bottom, sides, and top directions as depicted as downward, side-to-side, and upward as shown in FIG. 4). Third cells 108 define a third depth 110 that extends from to second intermediate sheet layer 78B to sheet layer 82. In certain exemplary embodiments, third depth 110 can be less than or equal to second depth 106. In the example shown in FIG. 4, third depth 110 is less than second depth 106 which is less than first depth 102.

During operation of propulsion system 10, a rotary seal element (e.g., a tooth of a labyrinth seal, a.k.a. a rotary tooth) would be positioned above relative to insert 70' as shown in FIG. 4. In the event of insert 70' taking a rub from the rotary seal element, the rotary seal element would come into contact with sheet layer 82 and dig into a portion of lattice layer 74 potentially penetrating down into third cells 108, second cells 104, and/or first cells 100. During a rub event (e.g., of a labyrinth tooth digging into insert 70'), air continues to flow past the labyrinth tooth and insert 70' by curving down into lattice layer 74 and around the labyrinth tooth.

With third cells 108 having a relatively small depth, there is not as much room for the air to go down and come back up around the labyrinth tooth as compared to an example without intermediate sheet layers. As air passes down through third cells 108, the air has a higher floor below the air to go down into third cells 108 and pass underneath the labyrinth tooth.

In this way, insert 70' with multiple intermediate sheet layers (e.g., first intermediate sheet layer 78A and second intermediate sheet layer 78B) at varying depths (e.g., first, second, and third depths 102, 106, and 110) provides more of a restriction for air passing across the labyrinth tooth and resulting in less air flow across the labyrinth tooth thereby reducing the overall leakage across insert 70' in the event a rub occurs.

Figure 5:
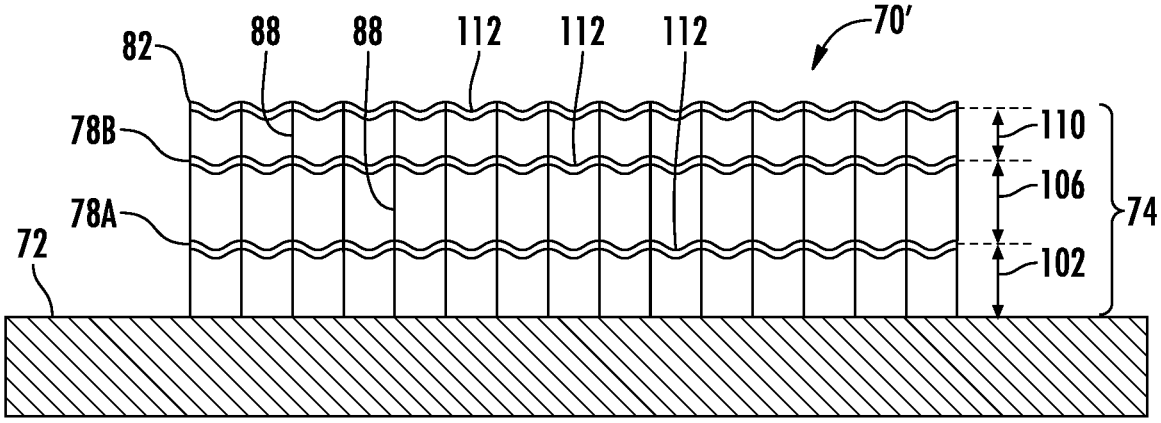
FIG. 5 is a cross-section view of an abradable insert and shows the intermediate sheet layers and the sheet layer with dimples in accordance with still another exemplary aspect of the present disclosure.

Referring now to FIG. 5, FIG. 5 is a cross-section view of an insert 70' in accordance with another exemplary embodiment of the present disclosure. The insert 70' may be configured in a similar manner as the exemplary insert 70 of FIG. 4. However, for the embodiment of FIG. 5, the insert 70' includes a plurality of dimples 112 in each of first intermediate sheet layer 78A, second intermediate sheet layer 78B, and sheet layer 82.

Dimples 112 are depressions or domes (e.g., concave or convex relative to base layer 72). As shown in FIG. 5, each of first cells 100, second cells 104, and third cells 108 include dimples 112 formed in the corresponding portions of first intermediate sheet layer 78A, second intermediate sheet layer 78B, and sheet layer 82. In certain exemplary embodiments, a single one of (e.g., sheet layer 82) or a combination of any of first intermediate sheet layer 78A, second intermediate sheet layer 78B, and sheet layer 82 can include dimples 112.

In this example, each dimple 112 of the plurality of dimples 112 is aligned with a cell of one of first cells 100, second cells 104, and third cells 108. More specifically, in at least certain exemplary aspects, a center or apex of a dimple is aligned with a center or centerpoint of one of first cells 100, second cells 104, and third cells 108.

In certain exemplary embodiments, dimples 112 can be oriented such that dimples 112 are concave away from base layer 72 and convex towards base layer (e.g., as shown in FIG. 5). In other exemplary embodiments, dimples 112 can be oriented such that dimples 112 are concave towards base layer 72 and convex away from base layer (e.g., an opposite orientation as shown in FIG. 5). Similarly, the orientation of dimples 112 across first intermediate sheet layer 78A, second intermediate sheet layer 78B, and sheet layer 82 can be non-uniform. In certain exemplary embodiments, one of first intermediate sheet layer 78A, second intermediate sheet layer 78B, and sheet layer 82 can have dimples 112 oriented in a first direction (e.g., concave away from base layer 72), while another of first intermediate sheet layer 78A, second intermediate sheet layer 78B, and sheet layer 82 can have dimples 112 oriented in a second direction (e.g., concave towards base layer 72) opposite from the first direction.

In this example, dimples 112 can be formed during a layer-by-layer additive manufacturing used to build each of first intermediate sheet layer 78A, second intermediate sheet layer 78B, and sheet layer 82 of lattice layer 74.

In certain exemplary embodiments, dimples 112 would be shallow enough such that the drag across dimples 112 would be much less than exposed (e.g., uncovered) honeycomb cells because sheet layer 82 is a continuous or substantially continuous surface. More specifically, in at least certain exemplary aspects, the dimpled surface of sheet layer 82 may reduce the overall drag on the stator (corresponding with insert 70') as compared to a different example of insert 70' with a smooth, non-dimpled surface.

Here, dimples 112 are utilized to provide for enhanced thermal strain relief to first intermediate sheet layer 78A, second intermediate sheet layer 78B, and sheet layer 82 and to lattice layer 74 as a whole. For example, during operation of propulsion system 10 lattice layer 74 of insert 70' can absorb thermal energy from the surrounding environment (e.g., directly from a rotating seal element), causing the various components of lattice layer 74 to expand. The curvature of dimples 112 allows dimples 112 to bulge as dimples 112 expand, thereby providing more room for each of dimples 112 to grow due to thermal expansion without breaking. This reduced localized thermal strain at dimples 112 also reduces the thermal strain applied to base layer 72 as each of first intermediate sheet layer 78A, second intermediate sheet layer 78B, sheet layer 82, and walls 88 thermally expand during operation.

Figure 6:
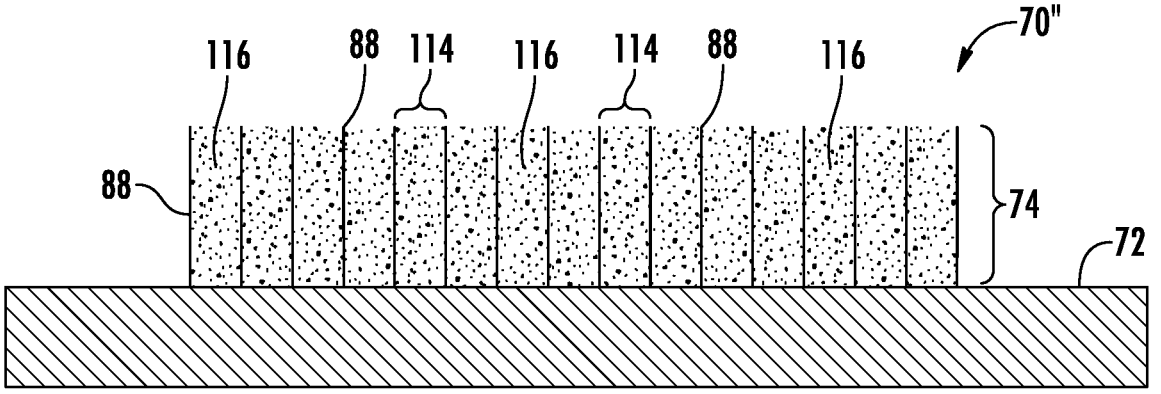
FIG. 6 is a cross-section view of an abradable insert with filler material in accordance with yet another exemplary aspect of the present disclosure.

Referring now to FIG. 6, FIG. 6 is a cross-section view of an insert 70" in accordance with another exemplary embodiment of the present disclosure. The insert 70" may be configured in a similar manner as the exemplary insert 70 of FIG. 3.

However, for the embodiment of FIG. 6, insert 70" includes cells 114 with a filler material 116 disposed in cells 114. Cells 114 are voids defined by walls 88 of insert 70". In this exemplary embodiment, cells 114 also extend from base layer 72 and across all of lattice layer 74. It will be appreciated, however, that in other exemplary embodiments, cells 114 may be further compartmentalized and defined by intermediate sheet layers (see, e.g., intermediate sheet layers 78, 78A, and 78B shown in FIGS. 2 through 5).

Filler material 116 is a porous filler material such as a matrix of metal fibers. More specifically, in at least certain exemplary embodiments, filler material 116 can include an austenitic stainless steel, an FeCrAlY alloy, an FeCrAlY composite, or any combination thereof. In this example, filler material 116 contains a high degree of abradability.

Filler material 116 can be applied to cells 100 of insert 70" such that cells 114 are filled with filler material 116 (or such that filler material 116 fills each cell 114 of the plurality of cells 114). In one exemplary embodiment, a plasma spray can be separately applied to cells before filling each cell 114 with filler material 116. In another exemplary embodiment, filling cells 114 with filler material 116 can include plasma spraying filler material 116 into cells 114. Each of cells 114 is filled with filler material 116 to create a smooth surface along the upper edges (upper towards to top surface of insert 70" as shown in FIG. 6) of cells 114.

During operation of propulsion system 10, as insert 70" takes a rub from a rotary seal element, the surface along which the rotary seal element rubs against cells 114 and filler material 116 creates a new smooth surface. In such a situation, where the rub event creates the new smooth surface, the high degree of abradability of filler material 116 enables insert 70 to create and maintain a smooth surface to continue to interact with the rotary seal element.

In this way, insert 70" with filler material 116 creating a smooth surface as a result of a rub event, provides a more effective fluidic seal for air passing across the rotary seal element. Because filler material 116 of insert 70" creates a more effective fluidic seal, less air is allowed to pass across the rotary seal element thereby reducing the overall leakage across insert 70" in the event a rub occurs.

As will be appreciated, filler material 116 can be combined with any of the embodiments provided herein by FIGS. 1 through 9. For example, filler material 116 can be added to any of first layer 76, second layer 80, first cells 100, second cells 104, third cells 108 in any of inserts 70 or 70' and with or without sheet layer 82.

Figure 7:
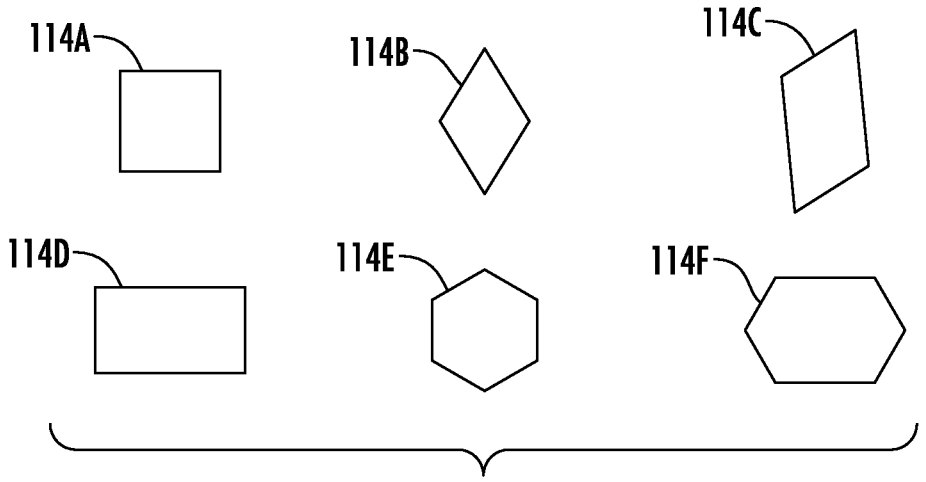
FIG. 7 is a simplified view of various shapes of cells of a lattice layer of the abradable insert in accordance with still another exemplary aspect of the present disclosure.

Referring now to FIG. 7, FIG. 7 is a simplified view of various shapes of cells 114A through 110F in accordance with an exemplary embodiment of the present disclosure. While the cells in FIG. 7 are referred to as cells 114A through 110F, it will be appreciated that cells 114A through 110F can also refer to any of cells shown in any of FIGS. 1 through 8 (for example the cells formed by walls 88 and intermediate sheet layer 78, first cells 100, second cells 104, and third cells 108).

In this example, the views of cells 114A through 110F are a top view of a single cell 114 of an insert (such as insert 70, 70', 70"). Cell 114A includes a square cross-section shape. Cell 114B includes a rhombus cross-section shape. Cell 114C includes a rhomboid cross-section shape. Cell 114D includes a rectangle cross-section shape. Cell 114F includes a hexagon cross-section shape. Cell 114E includes an elongated rhombus cross-section shape. In such a manner, it will be appreciated that a cell of the present disclosure may define any suitable shape, such as a suitable triangle, quadrilateral, pentagon, hexagon, etc.

Figure 8:
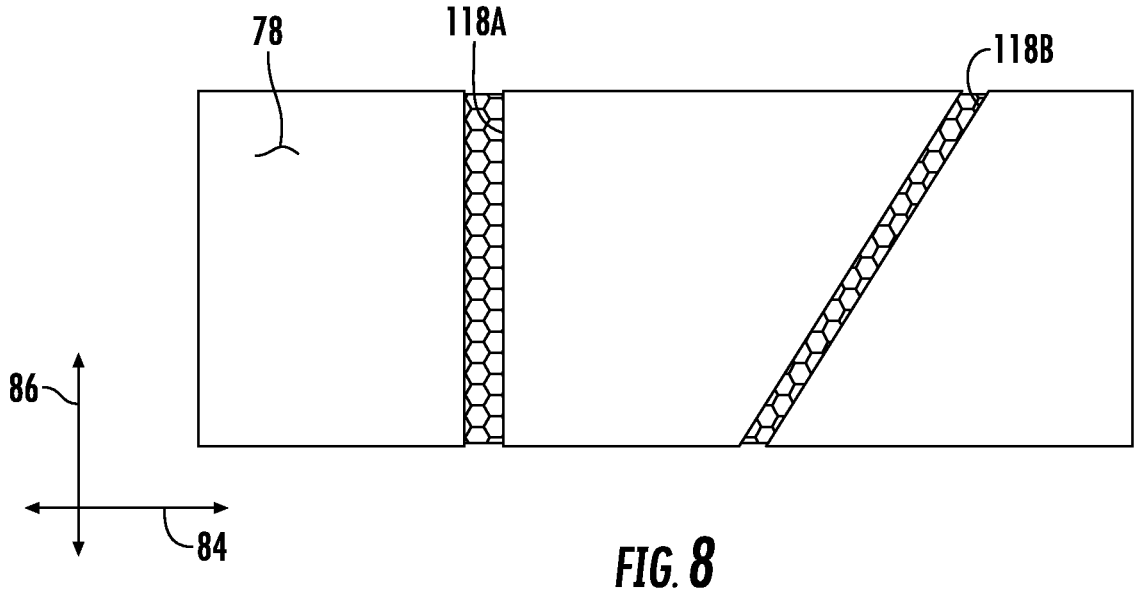
FIG. 8 is a figure showing relief gaps in the intermediate sheet layer in accordance with yet another exemplary aspect of the present disclosure.

Referring now to FIG. 8, FIG. 8 is a top isolation view of intermediate sheet layer 78 in accordance with an exemplary embodiment of the present disclosure.

As shown in FIG. 8, intermediate sheet layer 78 defines a gap 118A and a gap 118B along intermediate sheet layer 78.

Gap 118A and gap 118B are breaks or relief cuts defined by or cut out of sections of intermediate sheet layer 78. For this embodiment, intermediate sheet layer 78 is shown as including gap 118A and gap 118B. It will be appreciated, however, that in other exemplary embodiments, any of first intermediate sheet layer 78A, second intermediate sheet layer 78B, sheet layer 82, or a combination thereof can include and/or define one or more of gap 118A and of gap 118B. In certain exemplary embodiments, gap 118A and gap 118B can be formed as intermediate sheet layer 78 is built by a layer-by-layer additive manufacturing process.

In FIG. 8, gap 118A and gap 118B are shown as extending along second direction 86 from one edge of intermediate sheet layer 78 to the other edge of intermediate sheet layer 78. As shown in FIG. 8, gap 118B also extends along first direction 84 to form a diagonal orientation along intermediate sheet layer 78. In certain exemplary embodiments, gap 118A and 118B are defined by intermediate layer 78 to include straight line cuts of uniform width through intermediate sheet layer 78. It will be appreciated, however, that in other exemplary embodiments, gap 118A and/or 118B can be defined by intermediate sheet layer 78 to include non-straight cuts (e.g., spiral, helical, or otherwise curved) with or without a constant width through intermediate sheet layer 78.

Gap 118A and gap 118B provide breaks in the continuity of intermediate sheet layer 78 so that intermediate sheet layer 78 does not form a full 360° arc in situ with other intermediate sheet layers 78 of other inserts 70 positioned to make an entire circumferential ring. For example, if intermediate sheet layer 78 were a continuous 360° ring, during instance of high thermal heat transfer from the honeycomb cell material to intermediate sheet layer 78, intermediate sheet layer 78 could try and grow faster than base layer 72. In such an instance, intermediate sheet layer 78 could grow radially outward faster than base layer 72, causing intermediate sheet layer 78 to push against the honeycomb cell material and possibly crushing the honeycomb cell material against base layer 72.

Gaps 118A, 118B may have any suitable width, such as between about A and B, such as between about C and D, such as between about E and F.

Gap 118A and gap 118B provide expansion-wise thermal strain relief for intermediate sheet layer 78. For example, gap 118A and gap 118B are disposed locally in certain locations spots, so that intermediate sheet layer 78 does not break or crack as intermediate sheet layer 78 expands due to linear thermal expansion in response to an increase in thermal energy (e.g., due to a rub event). In this way, gap 118A and 118B enable insert 70 (insert 70' or insert 70") to withstand high temperature differential along various parts of insert 70 without insert 70 breaking or cracking due to thermal linear expansion of insert 70.

Figure 9:
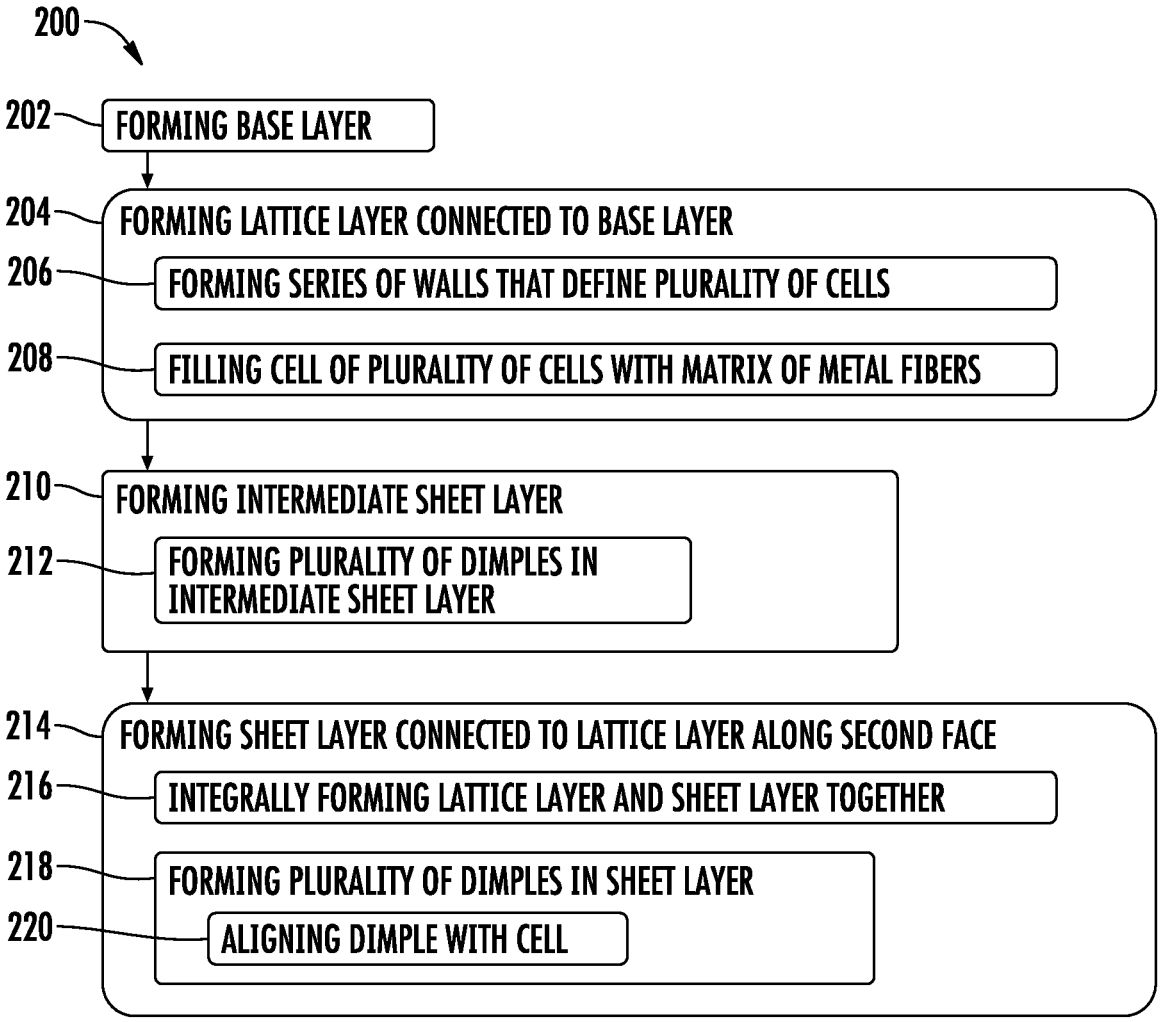
FIG. 9 is a flowchart of a method of making an abradable insert in accordance with still another exemplary aspect of the present disclosure.

Referring now to FIG. 9, FIG. 9 is a flowchart of a method 200 of making an abradable insert (e.g., insert 70, insert 70', or insert 70") in accordance with an exemplary embodiment of the present disclosure. Method 200 includes steps 202-220.

Step 202 includes forming base layer 72. In certain exemplary embodiments, step 202 can include forming base layer 72 with a layer-by-layer additive manufacturing process. It will be appreciated, however, that in other exemplary embodiments, step 202 can include forming base layer 72 with a non-additive manufacturing process.

Step 204 includes forming lattice layer 74 connected to base layer 72 by layer-by-layer additive manufacturing. Here, forming lattice layer 74 may include step 206 of forming a series of walls 88 that define a plurality of cells (such as first cells 100, such as second cells 104, such as third cells 108, or such as cells 114). Step 204 may also include step 208 of filling one cell of the plurality of cells with filler material 116 (e.g., a matrix of metal fibers).

Step 210 includes forming intermediate sheet layer 78 such that intermediate sheet layer 78 is disposed between sheet layer 82 and base layer 72. In certain exemplary embodiments, intermediate sheet layer 78 divides the plurality of cells into first layer 76 of cells and second layer 80 of cells. In other exemplary embodiments, step 210 may include step 212 of forming a plurality of dimples 112 in intermediate sheet layer 78.

Step 214 includes forming sheet layer 82 connected to lattice layer 74 with layer-by-layer additive manufacturing. In certain exemplary embodiments, step 214 may include step 216 of integrally forming lattice layer 74 and sheet layer 82 together via layer-by-layer additive manufacturing and such that lattice layer 74 and sheet layer 82 are a monolithic piece of material.

In other exemplary embodiments, step 214 may also include step 218 of forming a plurality of dimples 112 in sheet layer 82. In certain exemplary embodiments, step 218 may include step 220 of aligning one dimple 112 of the plurality of dimples 112 with one cell of the plurality of cells (such as first cells 100, such as second cells 104, such as third cells 108, or such as cells 114).

It will be appreciated that the inserts described herein are by way of example only, and that in other embodiments, an insert in accordance with another exemplary embodiment may be provided. For example, the insert may include any suitable number of intermediate layers (e.g., 1, 2, 3, 4, 5, 6, 7, 8, 9, etc.). Alternatively, the insert may not include any intermediate layers. Similarly, although the inserts described herein mostly include an outer sheet layer, in other embodiments, the insert may not include an outer sheet layer, and instead may include one or more intermediate layer, filler material, or both.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects are provided by the subject matter of the following clauses:

An abradable insert for a gas turbine engine, the abradable insert comprising: a base layer; a lattice layer connected to the base layer, wherein the lattice layer comprises a series of walls that define a plurality of cells; and a sheet layer connected to the lattice layer on an opposite side on the lattice layer from the base layer, wherein the sheet layer is curved and includes a direction of concavity that points away from the base layer, wherein the lattice layer and the sheet layer are integrally formed together and are a monolithic piece of material.

The abradable insert of one or more of these clauses, wherein a thickness of each wall of the series of walls of the lattice layer and a thickness of the sheet layer are each equal to or less than 5.0 thousandths of an inch.

The abradable insert of one or more of these clauses, further comprising an intermediate sheet layer, wherein the intermediate sheet layer is disposed between the sheet layer and the base layer, wherein the intermediate sheet layer divides the plurality of cells into a first layer of cells and a second layer of cells.

The abradable insert of one or more of these clauses, wherein the sheet layer, the intermediate sheet layer, or both comprise a plurality of dimples, wherein each dimple of the plurality of dimples is aligned with a cell of the plurality of cells.

The abradable insert of one or more of these clauses, wherein the intermediate sheet layer defines a relief gap extending through a portion of the intermediate sheet layer.

The abradable insert of one or more of these clauses, wherein the intermediate sheet layer is curved along a first direction, wherein the intermediate sheet layer is flat along a second direction, wherein the second direction is perpendicular to the first direction, wherein the relief gap extends in the second direction.

The abradable insert of one or more of these clauses, wherein the abradable insert defines a joint between the series of walls and one of the sheet layer or the intermediate sheet layer, and wherein a maximum thickness of the joint is equal to or less than 10.0 thousandths of an inch.

The abradable insert of one or more of these clauses, wherein the sheet layer defines a flowpath surface wall of the gas turbine engine.

The abradable insert of one or more of these clauses, wherein abradable insert is configured to form a sealing interface with a labyrinth seal of a low pressure turbine of the gas turbine engine.

The abradable insert of one or more of these clauses, wherein a cross-section shape of each cell of the plurality of cells comprises a quadrilateral.

The abradable insert of one or more of these clauses, wherein a cross-section shape of each cell of the plurality of cells comprises a rhomboid.

The abradable insert of one or more of these clauses, wherein a material of the abradable insert comprises a nickel alloy with a temperature threshold of greater than 700° Fahrenheit.

The abradable insert of one or more of these clauses, wherein the material of the abradable insert comprises a nickel-chromium-aluminum-iron alloy or a nickel-molybdenum alloy.

The abradable insert of one or more of these clauses, further comprising a porous filler material disposed in a cell of the plurality of cells, wherein the porous filler material fills the cell of the plurality of cells.

The abradable insert of one or more of these clauses, wherein the porous filler material comprises a matrix of metal fibers, wherein a material of the porous filler material comprises an austenitic stainless steel, an FeCrAlY alloy, an FeCrAlY composite, or any combination thereof.

A method of making an abradable insert for a gas turbine engine, the method comprising: forming, with layer-by-layer additive manufacturing, a lattice layer connected to a base layer, wherein forming the lattice layer comprises forming a series of walls that define a plurality of cells; and forming, with layer-by-layer additive manufacturing, a sheet layer connected to the lattice layer, wherein the sheet layer is curved and includes a direction of concavity that points away from the base layer, wherein the lattice layer and the sheet layer are integrally formed together via layer-by-layer additive manufacturing and are a monolithic piece of material.

The method of one or more of these clauses, further comprising forming a plurality of dimples in the sheet layer, wherein a dimple of the plurality of dimples is aligned with a cell of the plurality of cells.

The method of one or more of these clauses, further comprising forming an intermediate sheet layer, wherein the intermediate sheet layer is disposed between the sheet layer and the base layer, wherein the intermediate sheet layer divides the plurality of cells into a first layer of cells and a second layer of cells.

The method of one or more of these clauses, further comprising forming a plurality of dimples in the intermediate sheet layer.

The method of one or more of these clauses, further comprising filling a cell of the plurality of cells with a matrix of metal fibers.

An abradable insert for a gas turbine engine, the abradable insert comprising: a base layer; a lattice layer connected to the base layer, wherein the lattice layer comprises a series of walls that define a plurality of cells; and a porous filler material disposed in a cell of the plurality of cells, wherein the porous filler material comprises a matrix of metal fibers, wherein a thickness of each wall of the series of walls of the lattice layer is equal to or less than 5.0 thousandths of an inch.

We claim:

1. An abradable insert for a gas turbine engine, the abradable insert comprising:

a base layer;

a lattice layer connected to the base layer, wherein the lattice layer comprises a series of walls that define a plurality of cells; and a sheet layer connected to the lattice layer on an opposite side on the lattice layer from the base layer, wherein the sheet layer is curved and includes a direction of concavity that points away from the base layer;

an intermediate sheet layer, wherein the intermediate sheet layer is disposed between the sheet layer and the base layer, wherein the intermediate sheet layer divides the plurality of cells into a first layer of cells and a second layer of cells;

wherein the sheet layer, the intermediate sheet layer, or both comprise a plurality of dimples, wherein each dimple of the plurality of dimples is aligned with a cell of the plurality of cells.

2. The abradable insert of claim 1, wherein a thickness of each wall of the series of walls of the lattice layer and a thickness of the sheet layer are each equal to or less than 5.0 thousandths of an inch.

3. The abradable insert of claim 1, wherein the intermediate sheet layer defines a relief gap extending through a portion of the intermediate sheet layer.

4. The abradable insert of claim 3, wherein the intermediate sheet layer is curved along a first direction, wherein the intermediate sheet layer is flat along a second direction, wherein the second direction is perpendicular to the first direction, wherein the relief gap extends in the second direction.

5. The abradable insert of claim 1, wherein the abradable insert defines a joint between the series of walls and one of the sheet layer or the intermediate sheet layer, and wherein a maximum thickness of the joint is equal to or less than 10.0 thousandths of an inch.

6. The abradable insert of claim 1, wherein the sheet layer defines a flowpath surface wall of the gas turbine engine.

7. The abradable insert of claim 1, wherein abradable insert is configured to form a sealing interface with a labyrinth seal of a low pressure turbine of the gas turbine engine.

8. The abradable insert of claim 1, wherein a cross-section shape of each cell of the plurality of cells comprises a quadrilateral.

9. The abradable insert of claim 8, wherein a cross-section shape of each cell of the plurality of cells comprises a rhomboid.

10. The abradable insert of claim 1, wherein a material of the abradable insert comprises a nickel alloy with a temperature threshold of greater than 700 degrees Fahrenheit.

11. The abradable insert of claim 10, wherein the material of the abradable insert comprises a nickel-chromium-aluminum-iron alloy or a nickel-molybdenum alloy.

12. The abradable insert of claim 1, further comprising a porous filler material disposed in a cell of the plurality of cells, wherein the porous filler material fills the cell of the plurality of cells.

13. The abradable insert of claim 12, wherein the porous filler material comprises a matrix of metal fibers, wherein a material of the porous filler material comprises an austenitic stainless steel, an FeCrAlY alloy, an FeCrAlY composite, or any combination thereof.

14. An abradable insert for a gas turbine engine, the abradable insert comprising:

a base layer;

a lattice layer connected to the base layer, wherein the lattice layer comprises a series of walls that define a plurality of cells; and a sheet layer connected to the lattice layer on an opposite side on the lattice layer from the base layer, wherein the sheet layer is curved and includes a direction of concavity that points away from the base layer, wherein the sheet layer comprise a plurality of dimples, wherein each dimple of the plurality of dimples is aligned with a cell of the plurality of cells.

15. The abradable insert of claim 14, wherein a thickness of each wall of the series of walls of the lattice layer and a thickness of the sheet layer are each equal to or less than 5.0 thousandths of an inch.

16. An abradable insert for a gas turbine engine, the abradable insert comprising:

a base layer;

a lattice layer connected to the base layer, wherein the lattice layer comprises a series of walls that define a plurality of cells;

a sheet layer connected to the lattice layer on an opposite side on the lattice layer from the base layer, wherein the sheet layer is curved and includes a direction of concavity that points away from the base layer; and an intermediate sheet layer, wherein the intermediate sheet layer is disposed between the sheet layer and the base layer, wherein the intermediate sheet layer divides the plurality of cells into a first layer of cells and a second layer of cells, wherein the abradable insert defines a joint between the series of walls and one of the sheet layer or the intermediate sheet layer, and wherein a maximum thickness of the joint is equal to or less than 10.0 thousandths of an inch.

17. The abradable insert of claim 16, wherein a thickness of each wall of the series of walls of the lattice layer and a thickness of the sheet layer are each equal to or less than 5.0 thousandths of an inch.

18. The abradable insert of claim 16, wherein the intermediate sheet layer defines a relief gap extending through a portion of the intermediate sheet layer.

* * * * *